US007595636B2

(12) United States Patent
Barolak et al.

(10) Patent No.: US 7,595,636 B2
(45) Date of Patent: Sep. 29, 2009

(54) APPARATUS AND METHOD OF USING ACCELEROMETER MEASUREMENTS FOR CASING EVALUATION

(75) Inventors: Joseph Gregory Barolak, Spring, TX (US); Douglas W. Spencer, Williamsburg, MI (US); Jerry E. Miller, Traverse City, MI (US); Bruce I. Girrell, Traverse City, MI (US); Jason A. Lynch, Buckley, MI (US); Chris J. Walter, Empire, MI (US)

(73) Assignee: Baker Hughes Incorporated, Houston, TX (US)

( * ) Notice: Subject to any disclaimer, the term of this patent is extended or adjusted under 35 U.S.C. 154(b) by 28 days.

(21) Appl. No.: 11/078,536

(22) Filed: Mar. 11, 2005

(65) Prior Publication Data

US 2006/0202685 A1 Sep. 14, 2006

(51) Int. Cl.
*G01N 27/72* (2006.01)
*G01R 3/00* (2006.01)

(52) U.S. Cl. ..... 324/221; 324/338; 324/345

(58) Field of Classification Search ..... 324/220–221, 324/228, 235, 238, 240, 338, 345; 166/253.1, 166/250.05, 250.08
See application file for complete search history.

(56) References Cited

U.S. PATENT DOCUMENTS

| | | | | |
|---|---|---|---|---|
| 3,973,441 | A | 8/1976 | Porter | 73/432 R |
| 4,096,437 | A | 6/1978 | Kitzinger et al. | 324/227 |
| 4,468,619 | A | 8/1984 | Reeves | 324/220 |
| 4,659,991 | A | 4/1987 | Weischedel | 324/241 |
| 4,789,827 | A | 12/1988 | Bergander | 324/220 |
| 4,843,317 | A | 6/1989 | Dew | 324/221 |
| 4,945,306 | A | 7/1990 | Lowther | 324/220 |
| 5,293,117 | A | 3/1994 | Hwang | 324/220 |
| 5,397,985 | A | 3/1995 | Kennedy | 324/221 |
| 5,532,587 | A | 7/1996 | Downs et al. | 324/220 |
| 5,537,035 | A | 7/1996 | Fowler et al. | 324/220 |
| 5,585,726 | A * | 12/1996 | Chau | 324/326 |
| 5,670,878 | A | 9/1997 | Katahara et al. | 324/221 |
| 5,864,232 | A | 1/1999 | Laursen | 324/220 |
| 6,924,640 | B2 * | 8/2005 | Fickert et al. | 324/221 |
| 2003/0117134 | A1 | 6/2003 | Almaguer | 324/221 |
| 2004/0100256 | A1 | 5/2004 | Fickert et al. | 324/221 |

OTHER PUBLICATIONS

S. Mandayam et al.; *Wavelet-Based permeability compensation technique for characterizing magnetic flux leakage images*, NDT&E International, vol. 30, No. 5, pp. 297-303, 1997.

S. Mandayam et al.; *Wavelet-based permeability compensation technique for characterizing magnetic flux leakage images*, NDT&E International, vol. 30, No. 5, pp. 297-303, 1997, 7 Figs., Oct. 1996.

(Continued)

*Primary Examiner*—Reena Aurora
(74) *Attorney, Agent, or Firm*—Madan & Sriram, P.C.

(57) ABSTRACT

A casing inspection device with magnets and flux sensors. Measurements of axial motion of the device are used to get better definition of the axial extent of casing defects. A contact device may be used for motion measurement. The output of the contact device may be used to control the acquisition of flux measurements direction.

28 Claims, 9 Drawing Sheets

OTHER PUBLICATIONS

S. Mandayam; *Invariance Algorithms for Nondestructive Evaluation*, pp. 1-4, 6 Figs.
M. A. Siebert et al.; *Application of the Circumferential Component of Magnetic Flux Leakage Measurement for In-Line Inspection of Pipelines*, pp. 1-11, 14 Figs.
J. Sutherland et al.; *Advances in In-line Inspection Technology for Pipeline Integrity*, V Annual International Pipeline Congress, Oct. 18-20, 2000, Morelia, Mexico, pp. 1-13, 10 Figs.
S. Westwood et al.; *Independent Experimental Verification of the Sizing Accuracy of Magnetic Flux Leackage Tools*, CIN-042, 7th International Pipeline Conference, Nov. 12-14, 2003, Puebla, Mexico. pp. 1-7, 8 Figs., Appendix I (2 sheets).
S.P. Cholowsky; *The Use of Tri-axial Sensors to Better Determine Defect Parameters From Magnetic Flux Leakage Signals*, pp. 1-9, 10 Figs.
S. Cholowsky et al.; *Tri-axial Sensors and 3-Dimensional Magnetic Modelling of Defects Combine to Improve Defect Sizing from Magnetic Flux Leakage Signals*, NACE International the Corrosion Society, Northern Area Western Conference Feb. 16-19, 2004, Victoria, BC, pp. 1-8, 7 Figs.
BJ Pipeline Inspection Services, *Pipeline Inspection Services*, 1 page.
J. B. Nestleroth et al.; *Magnetic Flux Leakage (MFL) Technology for Natural Gas Pipeline Inspection* file://C\Documents and Settings\dwspencer\Local\Settings\TemporaryInternetFilies/OLK, 2 pgs.
J. Gilbert; *Technical Advances in Hall-Effect Sensing*, Allegro MicroSystems, Inc., Technical Paper, STP-00-1, pp. 1-6, 6 Figs.
J. B. Nestleroth; *Implementing Current In-line Inspection Technologies on Crawler Systems*, Technical Status Report, Apr. 2004, pp. 1-2, 9 Figs., 1 Table.
J.M. Makar et al; *Magnetic Field Techniques for the Inspection of Steel Under Concrete Cover*, Institute for Research in Construction, pp. 1-28.

* cited by examiner

APPARATUS AND METHOD OF USING ACCELEROMETER MEASUREMENTS FOR CASING EVALUATION

CROSS REFERENCES TO RELATED APPLICATIONS

This application is related to two United States patent applications with the same inventors being filed concurrently with the present application.

BACKGROUND OF THE INVENTION

1. Field of the Invention

The invention is in the field of measurement of casing thickness in wellbores. Specifically, the invention is directed towards magnetic flux leakage measurements to determine variations in casing morphonogy.

2. Description of the Related Art

Wells drilled for hydrocarbon production are completed with steel casing whose purpose is to control pressure and direct the flow of fluids from the reservoir to the surface. Mechanical integrity of the casing string is important for safety and environmental reasons. Corrosion may degrade the mechanical integrity of a casing and tubing string over time. The mechanical integrity must be estimated or otherwise ascertained by production engineers in order to assess the need for casing repair or replacement prior to failure.

Several devices for the remote sensing of the casing condition are available. For example, there are casing imaging systems based on acoustical principles. Use of acoustic measurements requires that the casing be filled with a liquid of constant density whose flow rate is low enough so that the acoustic signals are not lost in noise produced by moving fluids. When conditions favorable for acoustic imaging are not met, mechanical calipers have been used. One drawback of mechanical calipers is that they may cause corrosion of the casing under certain circumstances.

Various magnetic and electromagnetic techniques have been utilized to detect anomalies in casing. For example, U.S. Pat. No. 5,670,878 to Katahara et al. discloses an arrangement in which electromagnets on a logging tool are used to produce a magnetic field in the casing. A transmitting antenna is activated long enough to stabilize the current in the antenna and is then turned off. As a result of the turning off of the antenna current, eddy currents are induced in the casing proximate to the transmitting antenna. The induced eddy currents are detected by a receiver near the transmitting antenna. Such devices have limited azimuthal resolution. Eddy current systems are generally is less sensitive to defects in the internal diameter (ID) and more prone to spurious signals induced by sensor liftoff, scale and other internal deposits.

Magnetic inspection methods for inspection of elongated magnetically permeable objects are presently available. For example, U.S. Pat. No. 4,659,991 to Weischedel uses a method to nondestructively, magnetically inspect an elongated magnetically permeable object. The method induces a saturated magnetic flux through a section of the object between two opposite magnetic poles of a magnet. The saturated magnetic flux within the object is directly related to the cross-sectional area of the magnetically permeable object. A magnetic flux sensing coil is positioned between the poles near the surface of the object and moves with the magnet relative to the object in order to sense quantitatively the magnetic flux contained within the object.

U.S. Pat. No. 5,397,985 to Kennedy discloses use of a rotating transducer maintained at a constant distance from the casing axis during its rotation cycle. This constant distance is maintained regardless of variations in the inside diameter of the casing. The transducer induces a magnetic flux in the portion of the casing adjacent to the transducer. The transducer is rotated about the axis of the casing and continuously measures variations in the flux density within the casing during rotation to produce a true 360° azimuthal flux density response. The transducer is continuously repositioned vertically at a rate determined by the angular velocity of the rotating transducer and the desired vertical resolution of the final image. The transducer thus moves in a helical track near the inner wall of the casing. The measured variations in flux density for each 360° azimuthal scan are continuously recorded as a function of position along the casing to produce a 360° azimuthal sampling of the flux induced in the casing along the selected length.

The measured variations in flux density recorded as a function of position are used to generate an image. For the example of a magnetic transducer, the twice integrated response is correlatable to the casing profile passing beneath the transducer; this response can be calibrated in terms of the distance from the transducer to the casing surface, thus yielding a quantitatively interpretable image of the inner casing surface. In the case of electromagnetic transducers, operating frequencies can be chosen such that the observed flux density is related either to the proximity of the inner casing surface, or alternatively, to the casing thickness. Hence the use of electromagnetic transducers permits the simultaneous detection of both the casing thickness and the proximity of the inner surface; these can be used together to image casing defects both inside and outside the casing, as well as to produce a continuous image of casing thickness. The Kennedy device provides high resolution measurements at the cost of increased complexity due to the necessity of having a rotating transducer.

Any configuration relying on a single, central, magnetic circuit must be well centralized in the borehole in order to function well. Prior art casing technologies require at least one very powerful centralizing mechanism both above and below the magnetizer section. Such a configuration is disclosed, for example, in US 20040100256 of Fickert et al. It would be desirable to have a method and apparatus of measuring casing thickness that provides high resolution while being mechanically simple. The apparatus should preferably not require centralizing devices. The method should preferably also be able to detect defects on the inside as well as the outside of the casing. The present invention satisfies this need.

SUMMARY OF THE INVENTION

One embodiment of the invention is an apparatus for evaluating a tubular within a borehole. The apparatus comprises a tool conveyed within the borehole. The tool has associated with one or more magnets. One or more sensors are responsive to magnetic flux produced by the one or more magnets. A suitable device produces an output indicative of movement of the tool along an axis of the borehole. A processor determines an axial extent of a defect in the tubular based on an output of the one or more sensors and the output of the device. Electronic circuitry may be provided which controls acquisition of data by the one or more sensors based on the output of the device. The device may be a contact device that engages the tubular. The magnets may be arranged in one or more pairs, each pair of magnets being positioned on an inspection member extendable from a body of the tool. The sensors may be flux sensors responsive primarily to both internal and external defects of the tubular, and/or discriminator sensors responsive primarily to a defect internal to the tubular. The flux sensor may be a multicomponent sensor. The discriminator sensor may be a ratiometric Hall effect sensor. The apparatus may include an orientation sensor and may also have a wireline device which conveys the tool into the borehole.

The device providing an output indicative of tool movement may be an accelerometer. When this is the case, the processor may determine the axial extent of the defect using a depth determination based on spatial frequency filtering of the output of the accelerometer. The processor may determine the axial extent of the defect using a depth determination based on smoothing of the output of the accelerometer using wireline depth measurements.

Another embodiment of the invention is a method of evaluating a tubular within a borehole. A tool is conveyed into the borehole and a measurement of one or more components of magnetic flux produced by one or more magnets is made. A signal indicative of movement of the tool along an axis of the borehole is obtained. An axial extent of a defect in the tubular is determined based on the magnetic flux measurement and the signal indicative of the tool movement. The signal indicative of tool movement may be provided by a contact device: if so, the measurement of magnetic flux may be controlled by the signal of tool movement. The signal indicative of the tool movement may be output of an accelerometer. When an accelerometer signal is used, the axial extent determination may include a spatial frequency filtering of the acceleration output and/or smoothing of the accelerometer output using wireline depth measurements.

Another embodiment of the invention is a machine readable medium for use with an apparatus which characterizes a defect in a ferromagnetic tubular within a borehole. The apparatus includes a tool conveyed within the tubular, one or more magnets on the tool which produces a magnetic flux in the tubular, a sensor responsive to the magnetic flux, and a device responsive to axial motion of the tool. The medium includes instructions that enable determination from an output of the sensor and an output of the device an axial extent of a defect in the tubular. The medium may further include instructions for controlling acquisition of data by the sensor based on the output of the device. The device may be an accelerometer: if so, the medium further includes instructions for spatial filtering of the output of the accelerometer and/or smoothing of the accelerometer output using wireline depth measurements. The medium may be selected from the group consisting of (i) a ROM, (ii) an EPROM, (iii) an EEPROM, (iv) a Flash Memory, and (v) an Optical disk.

BRIEF DESCRIPTION OF THE DRAWINGS

The present invention is best understood with reference to the accompanying figures in which like numerals refer to like elements and in which.

DETAILED DESCRIPTION OF THE INVENTION

Figure 1:
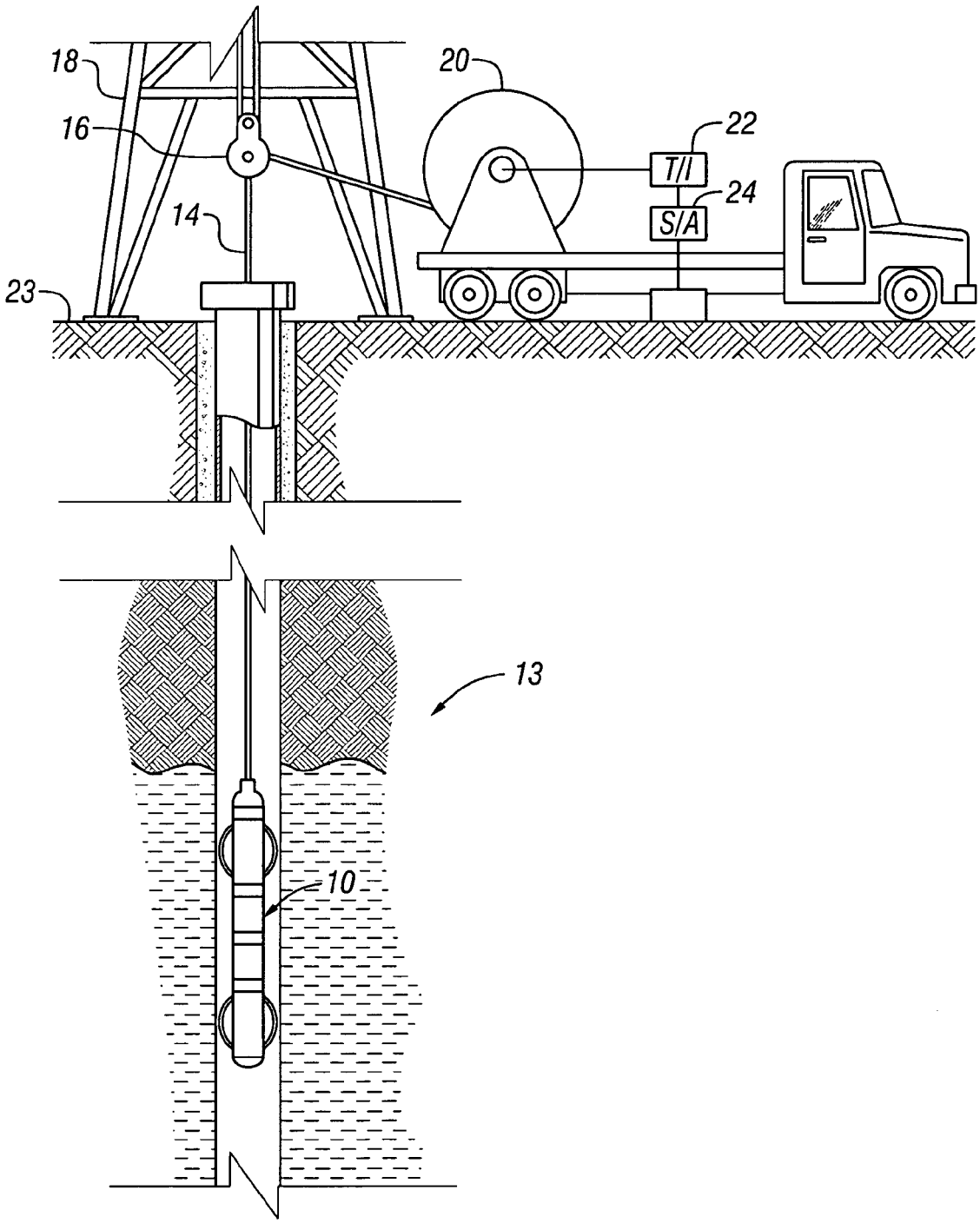
FIG. 1 (Prior Art)
FIG. 1 (prior art) schematically illustrates a wireline tool suspended in a borehole.

FIG. 1 shows an tool 10 suspended in a borehole 12, that penetrates earth formations such as 13, from a suitable cable 14 that passes over a sheave 16 mounted on drilling rig 18. By industry standard, the cable 14 includes a stress member and up to seven conductors for transmitting commands to the tool and for receiving data back from the tool as well as power for the tool. The tool 10 is raised and lowered by draw works 20. Electronic module 22, on the surface 23, transmits the required operating commands downhole and in return, receives data back which may be recorded on an archival storage medium of any desired type for concurrent or later processing. The data may be transmitted digital form. Data processors such as a suitable computer 24, may be provided for performing data analysis in the field in real time or the recorded data may be sent to a processing center or both for post processing of the data. Some or all of the processing may also be done by using a downhole processor at a suitable location on the tool 10. A downhole processor and memory are provided, the downhole processor being capable of operating independently of the surface computer.

Figure 2:
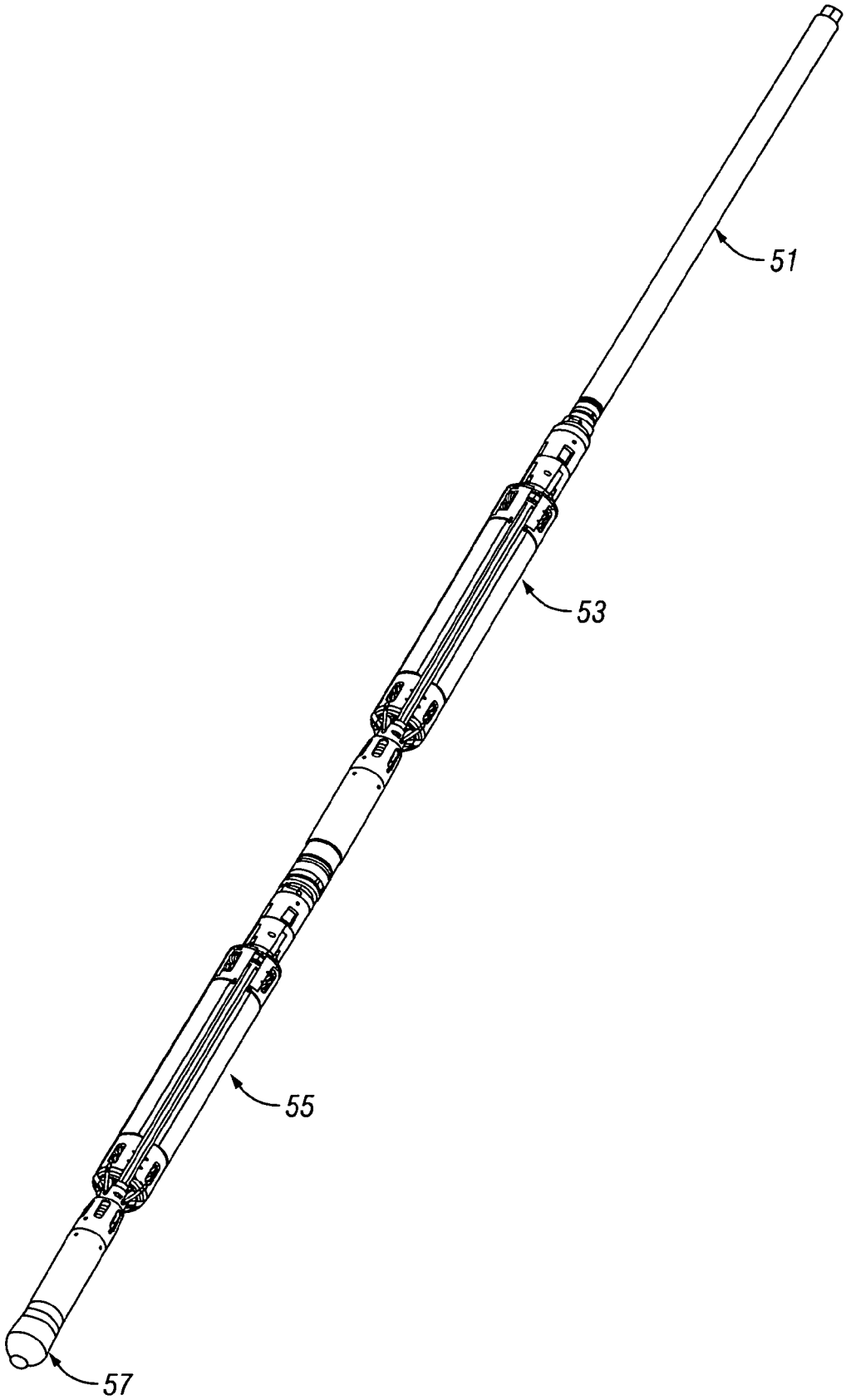
FIG. 2 is a perspective view of the main components of the logging instrument used in the present invention.

The logging instrument used in the present invention is schematically illustrated in FIG. 2. The electronics module 51 serves to pre-process, store, and transmit to the surface system the data that are generated by the inspection system. Two inspection modules 53, 55 are provided. The inspection modules include a series of individual inspection shoes that serve to magnetize the casing, as well as to deploy a series of flux leakage (FL) and defect discriminator (DIS) sensors around the inner circumference of the pipe. The upper and lower modules each have a plurality of FL and DIS sensors that are in a staggered configuration so as to provide complete circumferential coverage as the tool travels along the axis of the casing.

An advantage of the configuration of FIG. 2 is a substantial improvement for the shoe based approach is in regard to tool centralization. Any configuration relying on a single, central, magnetic circuit must be well centralized in the borehole in order to function well. Prior art casing technologies require at least one very powerful centralizing mechanism both above and below the magnetizer section. Such a configuration is disclosed, for example, in US 20040100256 of Fickert et al. The shoe-based magnetizer of the present invention is effectively a "self-centralizing" device, since the magnetic attraction between the shoe and the pipe serves to property position the shoes for logging, and no additional centralization is required.

Figure 3:
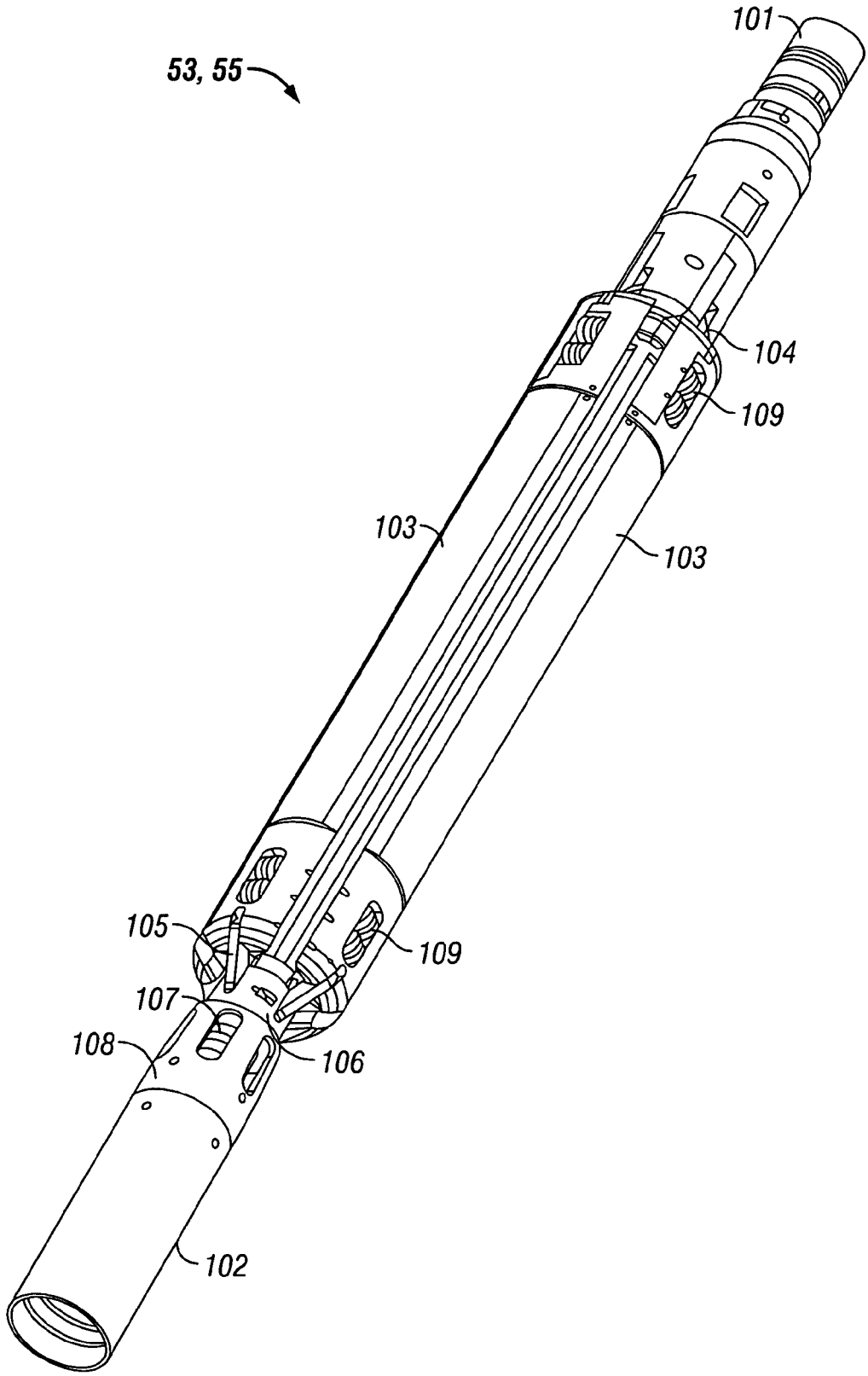
FIG. 3 is a perspective view of one of the inspection modules of FIG. 2.

One of the two inspection modules 53, 55 is shown in FIG. 3. The upper and lower modules are identical with the exception of the various "keying" elements incorporated in the male 101 and female 102 endcaps that serve to orient the modules relative to each other around the circumference and interconnection wiring details. This orientation between the upper and lower modules is necessary to overlap and stagger the individual inspection shoes 103.

A central shaft (not shown in FIG. 3) extends between the endcaps to provide mechanical integrity for the module. Tool joints incorporated within the endcaps provide mechanical make-ups for the various modules. Sealed multi-conductor connectors (not shown in FIG. 3) provide electrical connection between modules.

The inspection module is comprised of four identical inspection shoes arrayed around the central tool shaft/housing assembly in 90° increments, leaving the stagger between upper and lower modules as one half the shoe phasing, or 45°. Other casing sizes may employ a different number of shoes and a different shoe phasing to achieve a similar result.

Each inspection shoe is conveyed radially to the casing ID on two short arms, the upper sealing arm 104 serving as a "fixed" point of rotation in the upper (female) mandrel body, with the lower arm 105 affixed to a sliding cylinder, or "doughnut 106 that is capable of axial movement along the central shaft when acted upon by a single coil spring 107 trapped in the annulus between the central shaft and the instrument housing 108.

This configuration provides the module with the ability to deploy the inspection shoes to the casing ID with the assistance of the spring force. Once in close proximity to the casing ID, the attractive force between the magnetic circuit contained in the inspection shoe and the steel pipe serves to maintain the inspection shoe in contact with the casing ID during inspection.

Wheels 109 incorporated into the front and back of the shoe serve to maintain a small air gap between the shoe face and the casing ID. The wheels serve as the only (replaceable) wear component in contact with the casing, function to substantially reduce/eliminate wear on the shoe cover, and reduce friction of the instrument during operation. The wheels also serve to maintain a consistent gap between the sensors deployed in the shoe and the pipe ID, which aids, and simplifies, in the ability to analyze and interpret the results from different sizes, weights and grades of casing. Instead of wheels, roller bearings may be used.

Figure 4:
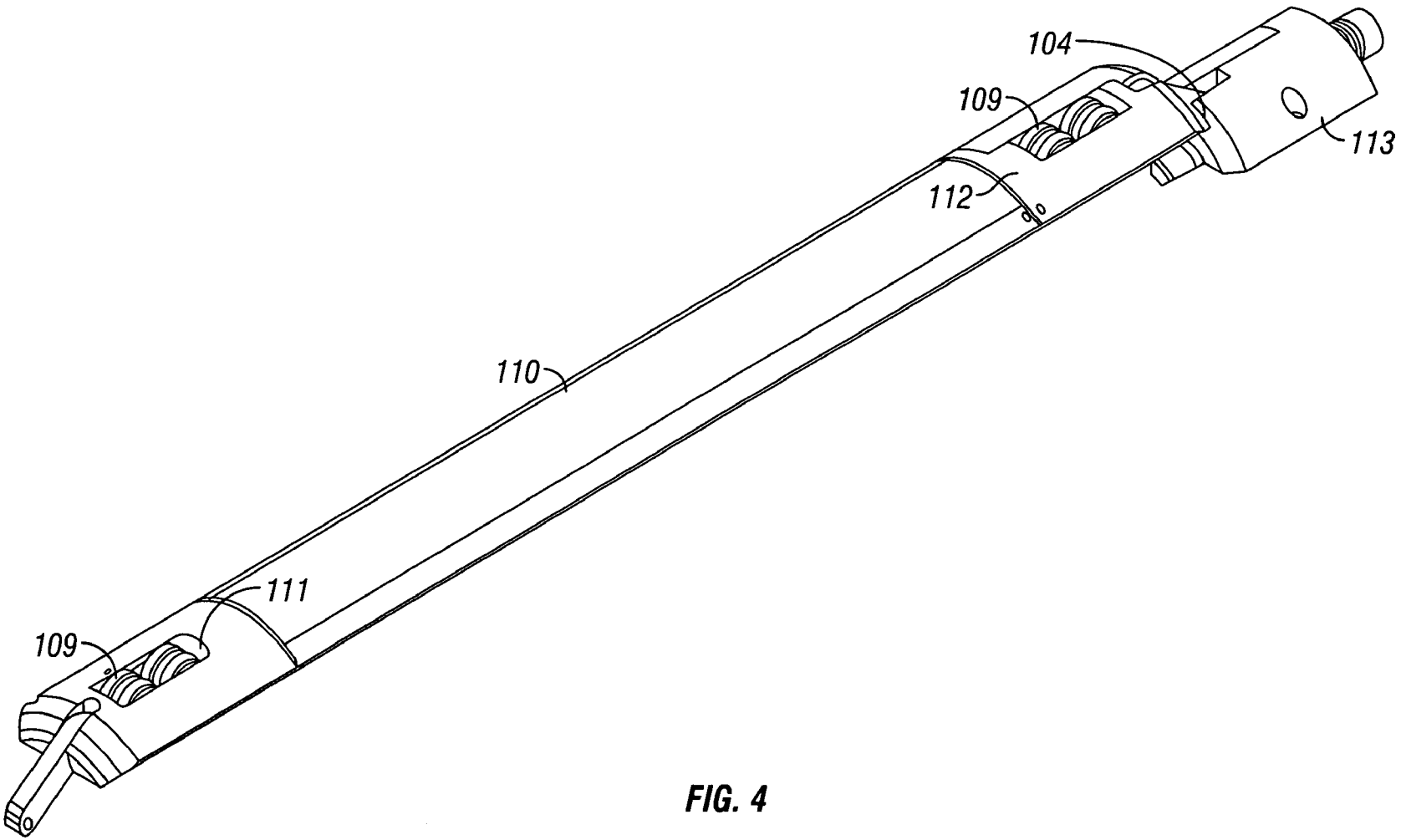
FIG. 4 illustrates a single inspection shoe assembly separated from the module body.

FIG. 4 illustrates a single inspection shoe assembly separated from the module body. The shoe assembly in this view is comprised of the inspection shoe cover 110, wheels 109, fixed shoe cap 111 and lower arm 105, the two piece sealing shoe cap 112, upper sealing arm 104, and two piece shoe bulkhead assembly 113. One advantage of having this arrangement is that it makes it easy to change out a malfunctioning shoe/sensor while operating in the field.

The primary function of the inspection shoe is to deploy the magnetizing elements and individual sensors necessary for comprehensive MFL inspection. In the present invention, FL sensors that respond to both internal and external defects, as well as a "discriminator" (DIS) sensor configuration that responds to internal defects only are provided. Both the FL and DIS data provide information in their respective signatures to quantify the geometry of the defect that produced the magnetic perturbation. In addition, the data contains information that allows the distinction between metal gain and metal loss anomalies.

One additional data characteristic that is a unique function of the FL sensor employed (discussed in more detail below) is the ability to quantify changes in total magnetic field based on the "background" levels of magnetic flux as recorded by the sensor in the absence of substantial defects. This capability may be used to identify changes in body wall thickness, casing permeability, or both.

Another advantage of the magnetizer shoes lies in their dynamic range. Fixed cylindrical circuit tool designs must strike a compromise between maximizing their OD, which results in more magnet material closer to the pipe (heavier casing weights can then be magnetized), and tool/pipe clearance issues. Shoes effectively place the magnets close to the pipe ID, and their ability to collapse in heavy walled pipe and through restrictions provides better operating ranges from both a magnetic and mechanical perspective. In operation, the magnetizing shoes serve to magnetize the region of the pipe directly under the shoe, and to a lesser extent, the circumferential region of the pipe between the shoes of an inspection shoe assembly.

Since the FL and DIS sensor arrays are confined to the shoe assembly, the deployment of two magnetizing shoe arrays is necessary for complete circumferential coverage. The dual shoe modules are therefore dictated by circumferential sensor coverage.

Figure 5:
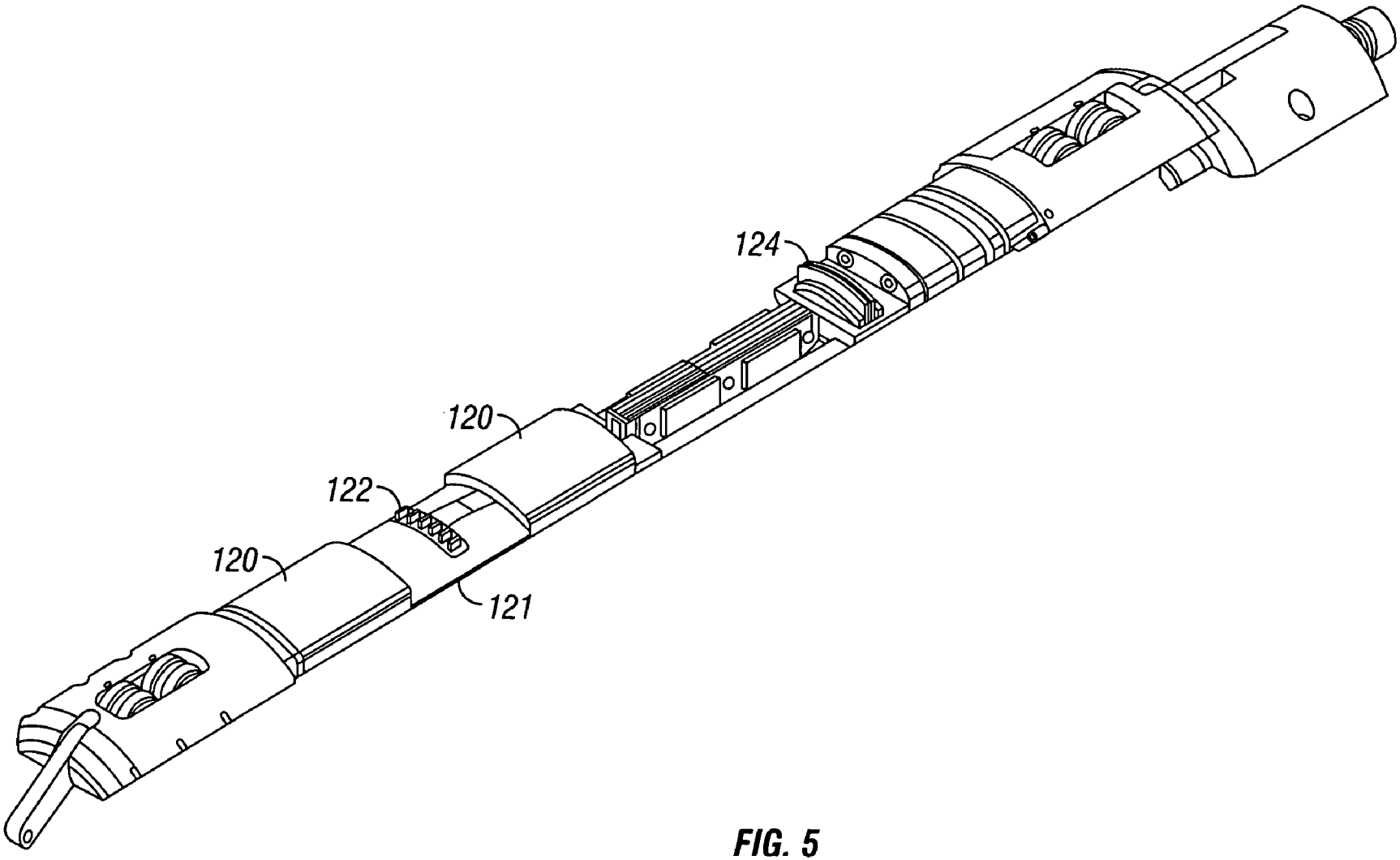
FIG. 5 shows a view of an individual inspection shoe.
Figure 6:
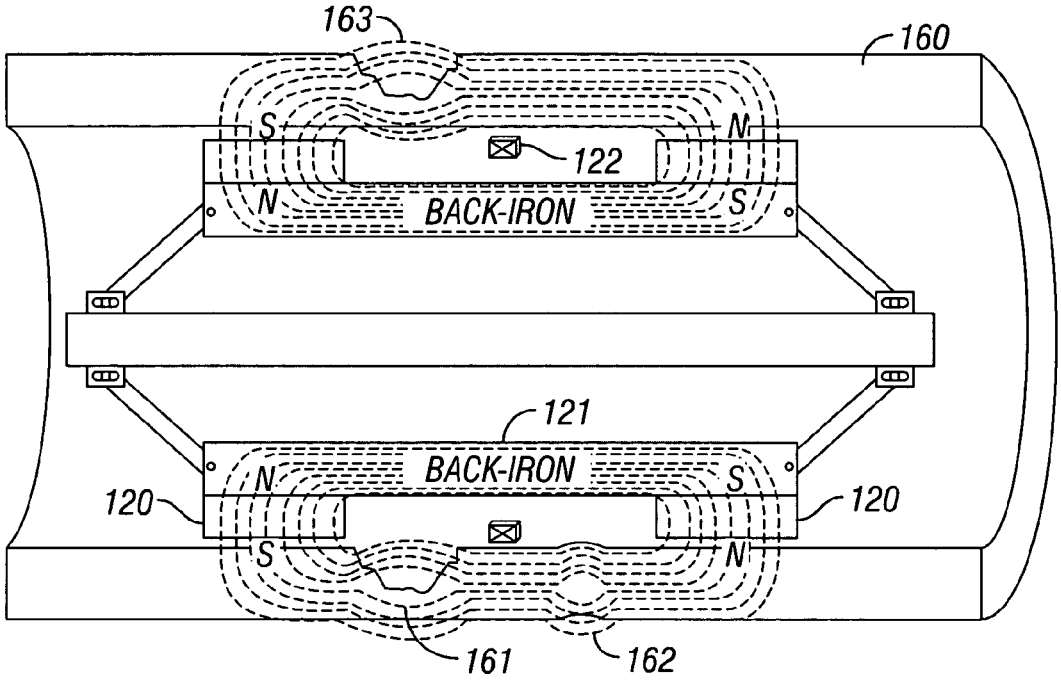
FIG. 6 shows a casing with a portion of the logging tool of the present invention.

The primary magnetic circuit is comprised of two Samarium Cobalt magnets 120 affixed to a "backiron" 121 constructed of highly magnetically permeable material. The magnets are magnetized normal to the pipe face, and the circuit is completed as lines of flux exit the upper magnets north pole, travel through the pipe material to the lower magnet south pole, and return via the back iron assembly. A series of flux leakage (FL) sensors 122 are deployed at the mid point of this circuit. In one embodiment of the invention, the circumferential spacing between the sensors is approximately 0.25 in., though other spacings could be used. In one embodiment of the invention, the FL sensors are ratiometric linear Hall effect sensors, whose analog output voltage is directly proportional to the flux density intersecting the sensor normal to its face. Other types of sensors could also be used. Also shown in FIG. 5 are the DIS sensor 124 discussed below The present invention relies on the deployment of its primary magnetizing circuit within a shoe, which, in combination with its adjacent shoes in the same module, serves to axially magnetize the steel casing under inspection, as shown in a simplified schematic of the tool/casing MFL interaction in FIG. 6. Also shown in FIG. 6 is a casing 160 that has corrosion 161 in its inner wall and corrosion 163 in its outer wall.

Figure 7:
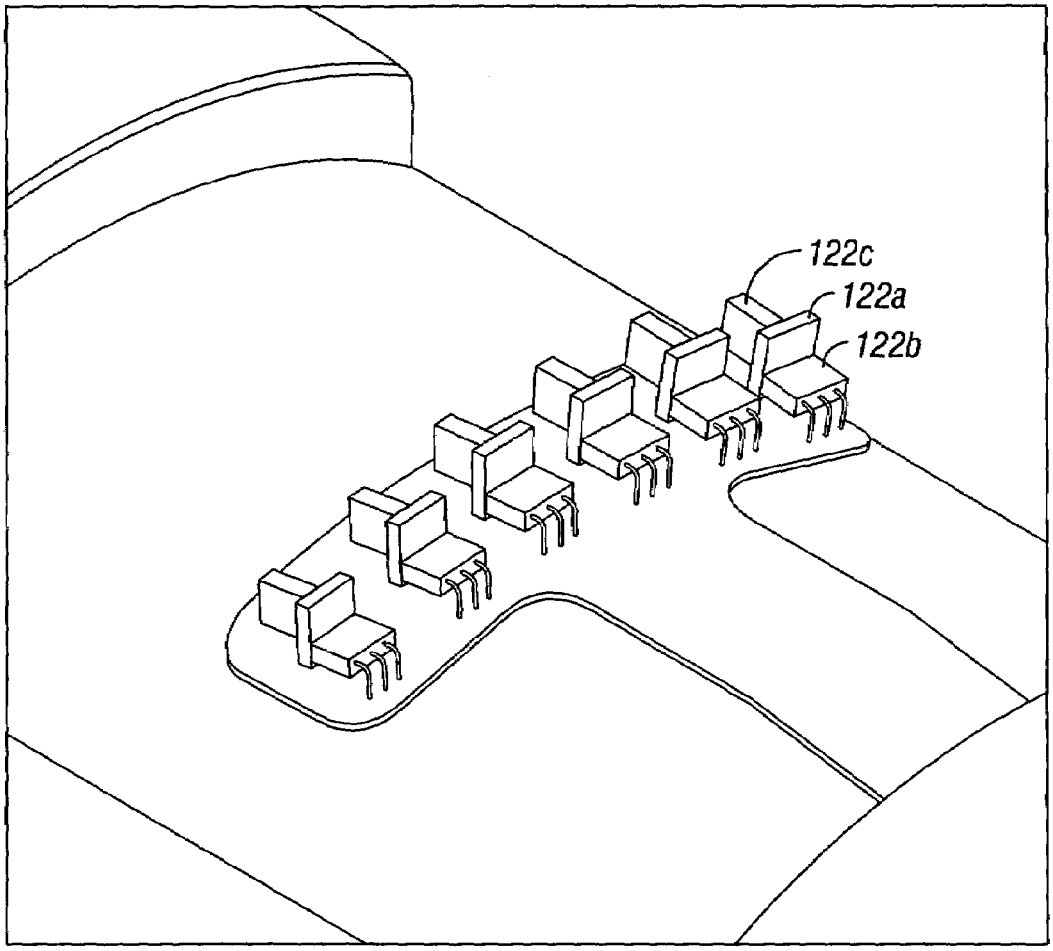
FIG. 7 shows the configuration of three-component flux sensors.

Hall sensors may ultimately be deployed in all three axis, such that the flux leakage vector amplitude in the axial 122*a*, radial 122*b* and circumferential 122*c* directions are all sampled, as illustrated in FIG. 7. The use of multicomponent sensors gives an improved estimate of the axial and circumferential extent, and depth of defects of the casing over prior art.

Figure 8:
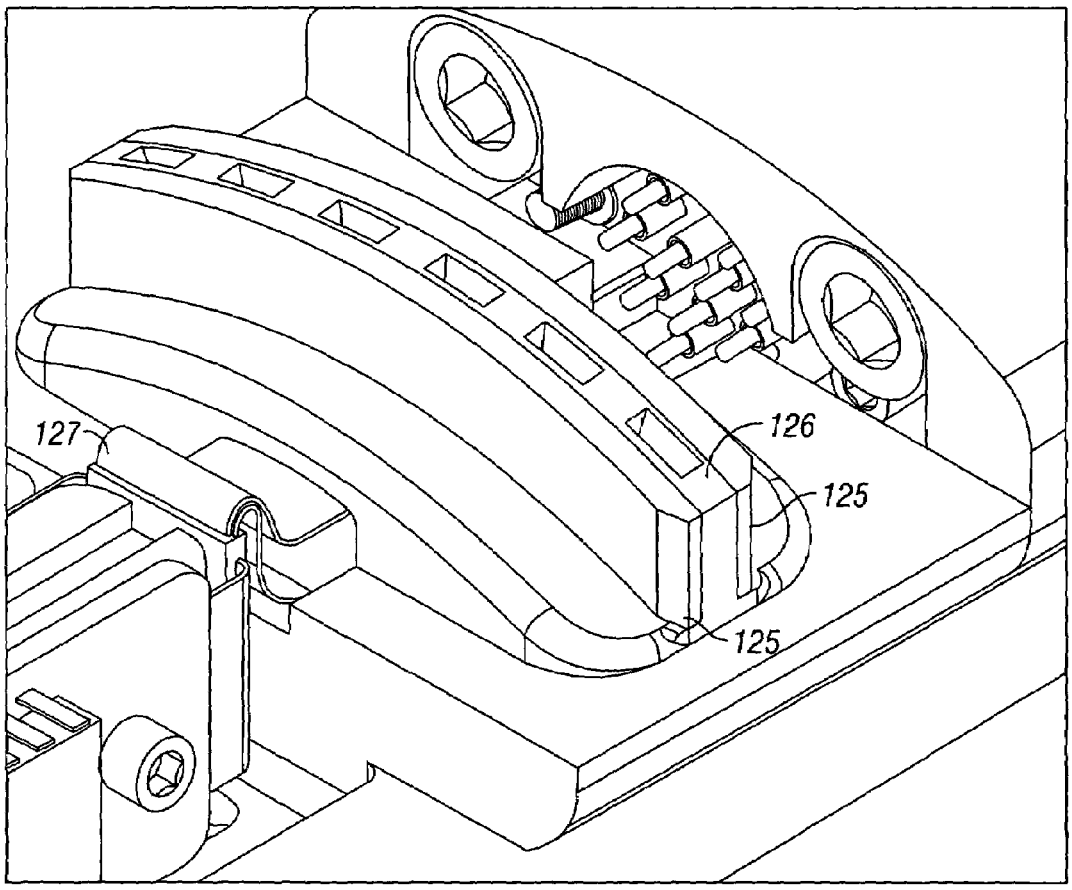
FIG. 8 shows the discriminator sensors used in the present invention.

Turning now to FIG. 8, the discriminator sensors are comprised of two small magnets 125 deployed on either side of a non-magnetic sensor chassis 126 that serves to hold Ratiometric linear Hall effect sensors (not shown in this figure) in position to detect the axial field.

The magnet components are magnetized in the axial direction, parallel to the casing being inspected, and serve to produce a weakly coupled magnetic circuit via shallow interaction with the casing ID. In the absence of an internal defect, the magnetic circuit remains "balanced" as directly measured by the uniform flux amplitude flowing through the Hall effect sensors positioned within the chassis.

As the discriminator assembly passes over an internal defect, the increased air gap caused by the "missing" metal of the ID defect serves to unbalance this circuit in proximity to the defect, and this change in flux amplitude (a flux decrease followed by a flux increase) is detected by the DIS Hall sensors positioned within this circuit, and serves to reveal the presence of an internal anomaly. The DIS sensors do not respond to external defects due to the shallow magnetic circuit interaction. This DIS technique also serves to help accurately define the length and width of internal defects, since the defect interaction with the DIS circuit/sensor configuration is localized.

Figure 9:
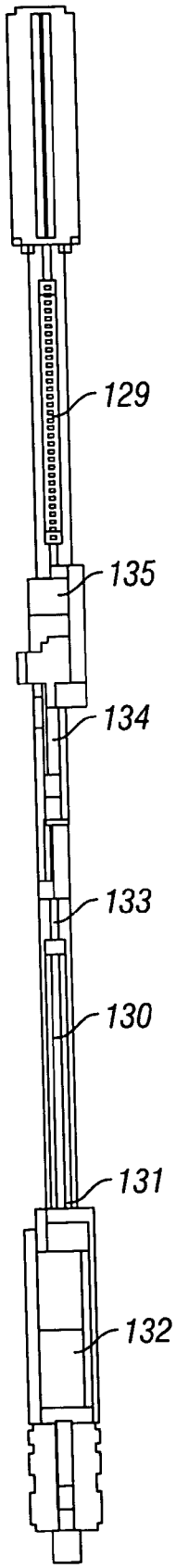
FIG. 9 illustrates the electronics module of the present invention.

The electronics module shown in FIG. 9 is comprised of an external insulating flask (not shown) and an electronics chassis populated with PCB cards to perform various functions of signal A/D conversion 129, data storage 130, and telemetry card 131. The electronics module also includes a battery pack 132, that may be a lithium battery, for non-powered memory applications, an orientation sensor package 133 to determine the tool/sensor circumferential orientation relative to gravity, a depth control card (DCC) 134 to provide a tool-based encoder interrupt to drive data acquisition. With the use of the depth control card, tool movement rather than wireline movement or time may controls the acquisition protocol. A 3-axis accelerometer module 135 may also be provided.

Both the DCC and the accelerometer may be incorporated in the design in order to improve on a phenomenon known to deal with problems caused by wireline stretch and tool stick/slip.

When a tool's data acquisition is driven by wireline movement line stretch causes discrepancies between the acquired depth/data point, and the actual depth of the tool. This can result in data/depth discrepancies of several feet in severe cases. When a tool contains adjacent circumferential sensors that are separated by an axial distance, as is the case with the present invention, then the problem of data depth alignment becomes more serious The DCC facilitates ensuring data and depth remain in synchronization, since the card serves to trigger axial data sampling based on actual movement of the tool, as determined from a device such as an external encoder wheel module (not shown) that makes contact with the pipe ID and produces an "acquisition trigger" signal based on encoder wheel (tool) movement.

In addition to as an alternative to this "mechanical" solution to data/depth alignment, a second "electronic" method employing accelerometers may be used. In this approach an on-board accelerometer acquires acceleration data at a constant (high frequency) time interval. At the very minimum, an axial accelerometer is used: two additional components may also be provided on the accelerometer. The accelerometer data is then used derive tool velocity and position changes during logging.

In one embodiment of the invention, the method taught in U.S. Pat. No. 6,154,704 to Jericevic et al., having the same assignee as the present invention and the contents of which are fully incorporated herein by reference, is used. The method involves preprocessing the data to reduce the magnitude of certain spatial frequency components in the data occurring within a bandwidth of axial acceleration of the logging instrument which corresponds to the cable yo-yo. The cable yo-yo bandwidth is determined by spectrally analyzing axial acceleration measurements made by the instrument. After the preprocessing step, eigenvalues of a matrix are shifted, over depth intervals where the smallest absolute value eigenvalue changes sign, by an amount such that the smallest absolute value eigenvalue then does not change sign. The matrix forms part of a system of linear equations which is used to convert the instrument measurements into values of a property of interest of the earth formations. Artifacts which remain in the data after the step of preprocessing are substantially removed by the step of eigenvalue shifting.

In an alternate embodiment of the invention, a method taught in U.S. patent application Ser. No. 10/926,810 of Edwards having the same assignee as the present invention and the contents of which are fully incorporated herein by reference. In Edwards, surface measurements indicative of the depth of the instrument are made along with accelerometer measurements of at least the axial component of instrument motion. The accelerometer measurements and the cable depth measurements are smoothed to get an estimate of the tool depth: the smoothing is done after the fact.

An important benefit of the improved depth estimate resulting from the processing of accelerometer measurements is a more accurate determination of the axial length of a defect.

The processing of the measurements made in wireline applications may be done by the surface processor 21 or at a remote location. The data acquisition may be controlled at least in part by the downhole electronics. Implicit in the control and processing of the data is the use of a computer program on a suitable machine readable medium that enables the processors to perform the control and processing. The machine readable medium may include ROMs, EPROMs, EEPROMs, Flash Memories and Optical disks.

While the foregoing disclosure is directed to the specific embodiments of the invention, various modifications will be apparent to those skilled in the art. It is intended that all such variations within the scope and spirit of the appended claims be embraced by the foregoing disclosure.

What is claimed is:

1. An apparatus for evaluating a tubular within a borehole, the apparatus comprising:

(a) a tool configured to be conveyed within the borehole;

(b) a flux sensor configured to be responsive to magnetic flux produced by at least one magnet associated with the tool;

(c) a downhole contact device in contact with the tubular configured to provide a signal responsive to a movement of the tool along an axis of the borehole; and (d) a processor configured to determine an axial extent of a defect in the tubular using an output of the flux sensor and the signal of the contact device indicative of the movement of the tool.

2. The apparatus of claim 1 further comprising electronic circuitry configured to control acquisition of data by the at least one sensor based on the output of the downhole contact device.

3. The apparatus of claim 1 wherein the at least one magnet comprises a plurality of magnets, each of the plurality of magnets disposed on an inspection member extendable from a body of the tool.

4. The apparatus of claim 1 wherein the magnetic flux is sensor is configured to be responsive primarily to the defect of the tubular.

5. The apparatus of claim 4 wherein the discriminator sensor further comprises a Hall effect sensor.

6. The apparatus of claim 4 wherein the flux sensor comprises a multicomponent sensor.

7. The apparatus of claim 1 wherein the flux sensor comprises a discriminator sensor responsive primarily to a defect internal to the tubular.

8. The apparatus of claim 1 further comprising an accelerometer.

9. The apparatus of claim 8 wherein the processor is configured to determine the axial extent of the defect using a depth determination based on spatial frequency filtering of the output of the accelerometer.

10. The apparatus of claim 8 wherein the processor is configured to determine the axial extent of the defect using a depth determination based on combining of the output of the accelerometer and a wireline depth measurement.

11. The apparatus of claim 1 further comprising an orientation sensor configured to provide an output indicative of an orientation of the flux sensor.

12. The apparatus of claim 1 further comprising a conveyance device configured to convey the tool into the borehole.

13. The apparatus of claim 1 wherein the downhole contact device is configured to be indicative of a position movement of the tool along an axis of the borehole by maintaining synchronization between the depth and a position of the flux sensor at which the output of the flux sensor is produced.

14. A method of evaluating a tubular within a borehole, the method comprising:

(a) conveying a tool into the borehole;

(b) making a measurement of at least one component of magnetic flux from at least one magnet associated with the tool with a flux sensor indicative of a defect in the tubular;

(c) using a downhole contact device in contact with the tubular for obtaining a signal responsive to a movement of the tool along an axis of the borehole; and (d) determining an axial extent of a defect in the tubular based on the measurement of the at least one component of the magnetic flux and the signal responsive to the tool movement.

15. The method of claim 14 further comprising using a spatial filtering of an output of an accelerometer.

16. The method of claim 14 wherein determining the axial extent of the defect further comprises the using an accelerometer output and wireline depth measurements.

17. The method of claim 14 further comprising conveying the tool into the borehole on a wireline.

18. The method of claim 14 further comprising controlling the measurement of the at least one component of magnetic flux based on the signal indicative of the tool position.

19. The method of claim 14 further comprising extending the at least one magnet away from a body of the tool.

20. The method of claim 14 wherein the at least one magnet comprises a plurality of magnets, the method further comprising positioning the plurality of magnets on a plurality of inspection modules.

21. The method of claim 14 further comprising determining a circumferential extent of the defect in the tubular based on the measurement of the magnetic flux.

22. The method of claim 14 further comprising determining a position of the tool along an axis of the borehole by maintaining synchronization between the depth and a position of a flux sensor used to make the measurement.

23. A machine readable medium for use with an apparatus which evaluates a ferromagnetic tubular within a borehole, the apparatus including:

(a) a tool conveyed within the tubular;

(b) at least one magnet on the tool which produces a magnetic flux in the tubular;

(c) a sensor responsive to the magnetic flux; and (d) a downhole contact device in contact with the tubular responsive to a movement of the tool along an axis of the borehole;

the medium comprising instructions that enable determining from an output of the sensor and an output of the device an axial extent of a defect in the tubular.

24. The machine readable medium of claim 23 further comprising instructions controlling acquisition of data by the sensor based on the output of the downhole contact device.

25. The machine readable medium of claim 23 wherein the apparatus further comprises an accelerometer, the medium further comprising instructions that enable the processor to perform spatial filtering of the output of the accelerometer.

26. The machine readable medium of claim 23 wherein the apparatus further comprises an accelerometer, the medium further comprising instructions that enables the processor to smooth the output of the accelerometer using wireline depth measurements.

27. The machine readable medium of claim 23 wherein the medium is selected from the group consisting of (i) a ROM, (ii) an EPROM, (iii) an EEPROM, (iv) a Flash Memory, and (v) an Optical disk.

28. The machine readable medium of claim 23 wherein the downhole contact device is configured to be indicative of a position of the tool along an axis of the borehole by maintaining synchronization between the depth and a position of the flux sensor at which the output of the flux sensor is produced.

* * * * *

UNITED STATES PATENT AND TRADEMARK OFFICE

CERTIFICATE OF CORRECTION

PATENT NO. : 7,595,636 B2
APPLICATION NO. : 11/078536
DATED : September 29, 2009
INVENTOR(S) : Joseph Gregory Barolak et al.

It is certified that error appears in the above-identified patent and that said Letters Patent is hereby corrected as shown below:

Column 8, claim 4, line 43, delete "magnetic flux is", insert --flux--;

Column 8, claim 5, line 46, delete "claim 4", insert --claim 7--;

Column 8, claim 9, line 58, delete "the output", insert --an output--;

Column 8, claim 10, line 61, delete "the output", insert --an output--;

Column 9, claim 13, line 4, delete "the depth", insert --a depth--;

Column 9, claim 16, line 23, delete "the using", insert --using--;

Column 9, claim 18, line 29, delete "the signal", insert --a signal--;

Column 9, claim 18, line 29, delete "the tool", insert --a tool--;

Column 10, line 1, delete "the depth", insert --a depth--;

Column 10, claim 25, line 23, delete "the output", insert --an output--;

Column 10, claim 26, line 25, delete "enables", insert --enable--;

Column 10, claim 26, line 26, delete "the output", insert --an output--; and

Column 10, claim 28, line 35, delete "the depth", insert --a depth--.

Signed and Sealed this

First Day of June, 2010

David J. Kappos

David J. Kappos
*Director of the United States Patent and Trademark Office*